US009747746B2

(12) United States Patent
Hawkins et al.

(10) Patent No.: US 9,747,746 B2
(45) Date of Patent: Aug. 29, 2017

(54) GAMING SYSTEM AND A METHOD OF GAMING

(71) Applicant: Aristocrat Technologies Australia Pty Limited, North Ryde (AU)

(72) Inventors: Ryan Paul Hawkins, Coffs Harbor (AU); Jamie Keith Langille, Las Vegas, NV (US)

(73) Assignee: Aristocrat Technologies Australia Pty Limited (AU)

( * ) Notice: Subject to any disclaimer, the term of this patent is extended or adjusted under 35 U.S.C. 154(b) by 478 days.

(21) Appl. No.: 13/960,547

(22) Filed: Aug. 6, 2013

(65) Prior Publication Data

US 2014/0045580 A1 Feb. 13, 2014

Related U.S. Application Data

(60) Provisional application No. 61/681,312, filed on Aug. 9, 2012.

(51) Int. Cl.
*G07F 17/32* (2006.01)

(52) U.S. Cl.
CPC ..... *G07F 17/3244* (2013.01); *G07F 17/3258* (2013.01)

(58) Field of Classification Search
USPC ..... 463/25
See application file for complete search history.

(56) References Cited

U.S. PATENT DOCUMENTS 6,224,482 B1 5/2001 Bennett
8,753,196 B2 * 6/2014 Baerlocher ..... G07F 17/32 463/16
2003/0060266 A1 * 3/2003 Baerlocher ..... G07F 17/32 463/20
2004/0007816 A1 * 1/2004 Thinnes ..... A63F 1/00 273/292
2005/0137017 A1 6/2005 Lechner et al.
2005/0143164 A1 6/2005 Duhamel et al.
(Continued)

FOREIGN PATENT DOCUMENTS

AU 2001100033 A4 5/2001
CA 2486065 A1 4/2006
(Continued)

OTHER PUBLICATIONS

"Fixed Point Arithmetic" published by Wikipedia on or before Oct. 28, 2011 and printed from URL <https://web.archive.org/web/20111028064549/http://en.wikipedia.org/wiki/Fixed-point_arithmetic>, 4 pages.*

*Primary Examiner* — Jason Skaarup

(74) *Attorney, Agent, or Firm* — McAndrews, Held & Malloy, Ltd.

(57) ABSTRACT

A gaming system that is arranged to facilitate selection of one or more win lines by a player is described. The gaming system comprises a weight allocator for allocating a weight to a wager, the allocated weight being dependent on a number of win lines selected by the player. The gaming system further comprises a prize allocator, and a trigger determiner arranged to determine a trigger condition, the trigger condition being dependent at least in part on the allocated weight. The gaming system is arranged to allocate a prize to a player in response to determination of the trigger condition.

69 Claims, 8 Drawing Sheets

(56) References Cited

U.S. PATENT DOCUMENTS

| | | | | |
|---|---|---|---|---|
| 2005/0192099 | A1* | 9/2005 | Nguyen | G06F 21/10 463/42 |
| 2007/0167238 | A1 | 7/2007 | Gatto et al. | |
| 2007/0202944 | A1 | 8/2007 | Oomori | |
| 2008/0090651 | A1* | 4/2008 | Baerlocher | G07F 17/3258 463/27 |
| 2009/0104986 | A1* | 4/2009 | Englman | G07F 17/3258 463/27 |
| 2010/0009740 | A1 | 1/2010 | Olive | |
| 2010/0041473 | A1 | 2/2010 | Bond | |
| 2010/0160031 | A1* | 6/2010 | Gilliland | G07F 17/32 463/20 |
| 2010/0234098 | A1 | 9/2010 | Hawkins | |
| 2010/0240447 | A1 | 9/2010 | Chan | |

FOREIGN PATENT DOCUMENTS

| | | | |
|---|---|---|---|
| CA | 2522640 | A1 | 6/2006 |
| GB | 2148037 | A | 5/1985 |
| GB | 2148037 | B | 2/1987 |
| JP | 2004166877 | A | 6/2004 |
| JP | 2005160931 | A | 6/2005 |
| JP | 2005253887 | A | 9/2005 |
| JP | 2006346066 | A | 12/2006 |
| JP | 2008295570 | A | 12/2008 |
| JP | 2008295571 | A | 12/2008 |
| JP | 2008295573 | A | 12/2008 |
| JP | 2009072626 | A | 4/2009 |
| JP | 2009112833 | A | 5/2009 |
| JP | 2009291361 | A | 12/2009 |
| JP | 2010000250 | A | 1/2010 |
| JP | 2010057758 | A | 3/2010 |
| JP | 4482316 | B2 | 6/2010 |
| JP | 2010220729 | A | 10/2010 |
| JP | 2010240046 | A | 10/2010 |
| JP | 2010268885 | A | 12/2010 |
| NZ | 523976 | A | 6/2004 |
| NZ | 544852 | A | 6/2007 |
| WO | 2005059849 | A1 | 6/2005 |
| WO | 2007084845 | A2 | 7/2007 |
| WO | 2007084845 | A3 | 1/2008 |
| WO | 2010015021 | A1 | 2/2010 |

* cited by examiner

GAMING SYSTEM AND A METHOD OF GAMING

RELATED APPLICATIONS

The application claims priority to U.S. Provisional Patent Application No. 61/681,312 having a filing date of Aug. 9, 2012, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Some jurisdictions impose limitations on gaming, for example by imposing maximum bet and/or maximum win per bought game amounts. In one specific example, gaming regulations impose a maximum bet of $2, and a maximum win per bought game of $500.

Such limitations present problems for implementing jackpot wins.

BRIEF SUMMARY OF THE INVENTION

In accordance with a first aspect of the present invention, there is provided a gaming system that is arranged to facilitate selection of one or more win lines by a player, the gaming system comprising:

a weight allocator for allocating a weight to a wager, the allocated weight being dependent on a number of win lines selected by the player;

a prize allocator; and a trigger determiner arranged to determine a trigger condition, the trigger condition being dependent at least in part on the allocated weight;

the gaming system being arranged to allocate a prize to a player in response to determination of the trigger condition.

The gaming system may be arranged to determine a trigger condition and/or allocate a prize only in response to a non-winning game.

In one embodiment the system is arranged to:

determine a trigger range based on a wager amount;

generate a random number within the trigger range;

determine whether the random number is within a subset of the trigger range, the subset of the trigger range being based on the allocated weight; and determine the trigger condition if it is determined that the random number is within the subset of the trigger range.

The trigger range may be a range from a minimum trigger range number to a maximum trigger range number, the maximum trigger range number being based on the wager amount. The subset of the trigger range may be a range from a minimum subset range number to a maximum subset range number, the maximum subset range number being based on the allocated weight. The minimum trigger range number and the minimum subset range number may be the same.

The system may further comprises a jackpot determiner, the jackpot determiner being arranged to store information that is indicative of at least one jackpot value and to allocate the at least one jackpot value as a prize to a player in response to determination of the trigger condition.

In one example, the jackpot determiner is arranged to store information that is indicative of a major jackpot prize and a minor jackpot prize, and is further arranged to make a determination as to whether the major or the minor jackpot prize is allocated. The jackpot determiner may determine which jackpot prize to allocate based on a jackpot weighting table. The major jackpot prize may be a maximum value that is allowed by gambling laws of a particular jurisdiction. The minor jackpot prize may be a progressive jackpot prize that has a starting minimum value and that increases by increments based on wagers that have been input to the gaming system until a maximum amount.

The minor jackpot prize may have an associated incrementing rate, that is, a proportion by which the minor jackpot prize increments with respect to each wager. For example, the minor jackpot prize may increment by 2% of each wager made in respect of the gaming system. The maximum amount of the minor jackpot prize may also be a maximum value that is allowed by gambling laws of a particular jurisdiction. The minor jackpot prize may be reset to the starting minimum value in response to the minor jackpot prize being allocated.

It will be appreciated that any number of jackpots may be used. For example, there may be a plurality of minor progressive jackpots. Each minor jackpot may have a respective incrementing rate.

The minimum and maximum trigger range numbers and the allocated weight may be multiplied by a predetermined factor. Multiplying the minimum and maximum trigger range numbers and the allocated weight by a predetermined factor may provide the advantage wherein a level of accuracy of the determination of the trigger condition is improved, and wherein a return to player percentage and awarded prizes are substantially proportional across different wager amounts.

In an alternative embodiment, the system is arranged to:

determine a trigger range based on a prize value;

generate a random trigger number within the trigger range;

increment a pool value by an amount based on the allocated weight for each non-winning wager;

determine if the pool value equals or exceeds the trigger number in response to incrementing the pool value; and determine the trigger condition if it is determined that the pool value equals or exceeds the trigger number.

The trigger range may be a range from a minimum trigger range number to a maximum trigger range number, the maximum trigger range number being based on the prize value. In one example, the maximum trigger range number is the same as a maximum prize value. The minimum trigger range number may be based on a further prize value. The minimum trigger range number may be the same as the further prize value.

The pool value may begin from a defined minimum pool value. In one example, the minimum pool value is the same as the further prize value.

In one example, the allocated prize is based on the random trigger number.

In accordance with a second aspect of the present invention, there is provided a method of gaming comprising the steps of:

facilitating selection of one or more win lines by a player;

allocating a weight to a wager, the allocated weight being dependent on a number of win lines selected by the player;

determining a trigger condition, the trigger condition being dependent at least in part on the allocated weight; and allocate a prize to a player in response to determination of the trigger condition.

The step of determining a trigger condition and/or allocating a prize may be performed only in response to a non-winning game.

In accordance with a third aspect of the present invention, there is provided a computer program arranged when loaded into a computing device to instruct the computing device to operate in accordance with the gaming system of the first aspect.

In accordance with a fourth aspect of the present invention, there is provided a computer readable medium having a computer readable program code embodied therein for causing a computing device to operate in accordance with the gaming system of the first aspect.

In accordance with a fifth aspect of the present invention, there is provided a data signal having a computer readable program code embodied therein to cause a computing device to operate in accordance with the gaming system of the first aspect.

BRIEF DESCRIPTION OF SEVERAL VIEWS OF THE DRAWINGS

In order that the present invention may be more clearly ascertained, embodiments of the present invention will now be described, by way of example only, with reference to the accompanying drawings, in which.

DETAILED DESCRIPTION OF THE INVENTION

Figure 1:
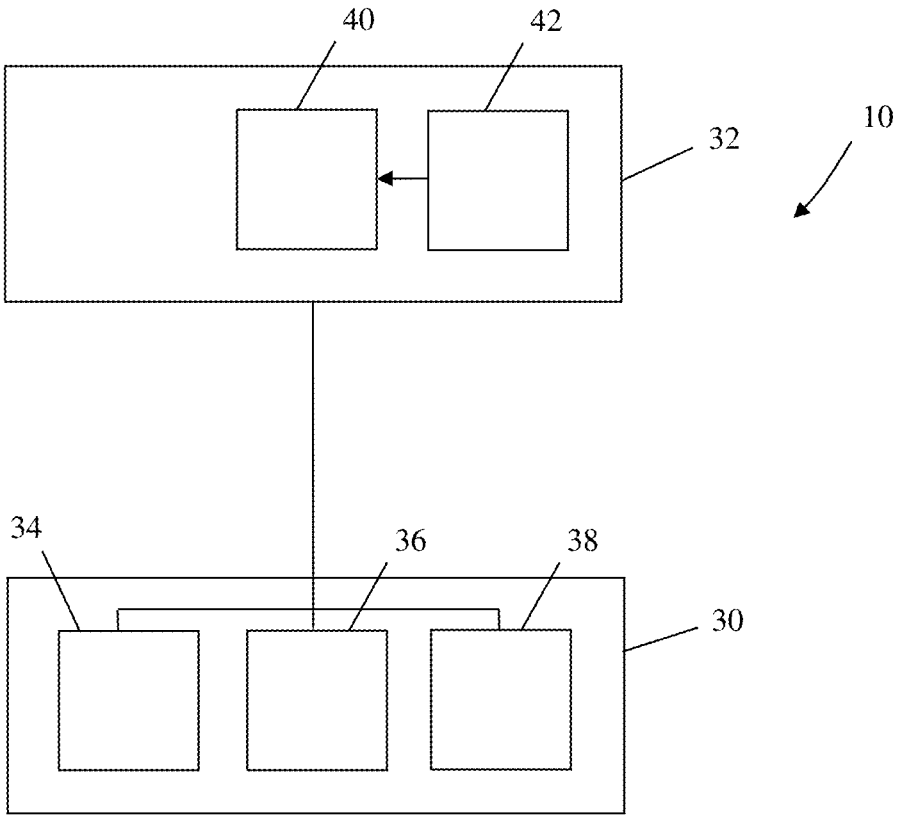
FIG. 1 is a schematic block diagram of components of a gaming system in accordance with an embodiment of the present invention.

Embodiments of the present invention relate to a gaming system and to a method of gaming. In general, the present gaming system operates such that, during game play, a plurality of symbols are randomly selected from a set of symbols and displayed at a corresponding plurality of display position groups, each of which comprises a plurality of display positions. The symbols shown at the display positions are used to determine game outcomes by comparing the displayed symbols with defined winning combinations.

In one conventional type of gaming machine, a display area including 15 display positions is presented to a player with each display position including one symbol. The display positions are arranged in five vertically disposed reels, with each reel having three visible display positions. After the reels are spun and subsequently stopped, the display positions show a random selection of symbols.

Generally, with such games, a plurality of win patterns in the form of win lines are defined which extend across the reels and include one display position from each reel. Typically the symbols that form a win line are compared with winning symbol combinations defined in a pay table so as to determine whether a player of the game should receive an award. For example, if winning symbol combinations are based on poker hands, a particular prize would be awarded if the win line comprises four aces. Other winning symbol combinations and corresponding prizes may also be defined by a pay table.

In an embodiment of the present invention, the gaming system is arranged to facilitate selection of one or more of the win lines by a player in response to the player making a wager. The gaming system allocates a weight to the wager, the weight being dependent on the number of win lines that were selected by the player, and determines a trigger condition that is dependent on the allocated weight. In response to determination of the trigger condition, the gaming system is arranged to allocate a prize.

The trigger condition can be determined in different ways, two examples of which are described below.

In a first example, the gaming system is arranged to determine a trigger range based on a wager amount. The trigger range is proportionally narrower for higher wager amounts such that the chance that a trigger condition is determined is proportional to the wager amount. For example, the trigger range may range from 1 to 20,000 for a wager of 5c, or from 1 to 10,000 for a wager of 10c.

The gaming system is also arranged to determine a subset of the trigger range, the subset being based on the allocated weight. In one example, the allocated weight is determined by the following weight allocation table:

TABLE 1

| | Number of Selected Win Lines | | | | |
|---|---|---|---|---|---|
| | 1 | 5 | 10 | 20 | 25 |
| Weight | 1.123 | 1.213 | 1.321 | 1.454 | 1.666 |

In one example, the subset of the trigger range ranges from 1 to a product of a total amount wagered for that particular game and the allocated weight. For example, if the player selects 20 lines for a total cost of 20c, the subset of the trigger range will range from 1 to 29.08 (i.e., (20)*(1.454)=29.08).

A random number that falls within the trigger range is then generated. If the random number that is generated falls within the subset of the trigger range, then the trigger condition is determined and a prize is allocated in response to determination of the trigger.

The allocated prize may be a jackpot prize. In one example, the allocated prize may be either a major or a minor jackpot prize, and the system may make a determination as to whether the major or the minor jackpot prize is allocated, for example by using a jackpot weighting table. One example of a jackpot weighting table is represented below:

TABLE 2

| | |
|---|---|
| Major Jackpot Prize | 1 |
| Minor Jackpot Prize | 99,999 |
| Total | 100,000 |

Using the example above, the gaming system can be arranged to generate a random number between 1 and 100,000. If the random number is equal to 1, then the major jackpot prize is awarded. If the random number falls within the range of 2 to 100,000, then the minor jackpot prize is awarded.

The major jackpot prize may be a maximum amount allowed by gambling laws within a particular jurisdiction. For example, in Illinois, USA, the major jackpot prize may be set to $500, being the maximum win per bought game that is allowable under current gaming regulations in Illinois. The minor jackpot prize may be a progressive jackpot that starts at a value of, for example, $20, and increments based on wagers that have been input to the gaming system until a maximum amount which, again, may be determined by gambling laws of a particular jurisdiction.

It will be appreciated that any number of jackpots may be used. For example, there may be a plurality of minor progressive jackpots, each having a respective incrementing rate based on wagers that have been input to the gaming system.

It will be appreciated that the trigger range and the subset of the trigger range can be multiplied by an appropriate factor, or even by different factors, so as to improve a level of accuracy of the determination of the trigger condition such that a return to player percentage and a probability of being awarded a prize are substantially proportional across different wager amounts.

In a second example, the gaming system is arranged to determine a trigger range based on a prize value and to generate a random trigger number within the trigger range. For example, the trigger range may range from a minimum jackpot prize level, such as $20, to a maximum jackpot level, such as $40. The random trigger number that is generated will fall within this range and may, for example, be $30.

A pool, such as a jackpot pool, is incremented by an amount based on the allocated weight for each non-winning wager. The allocated weight may be determined based on Table 1, as per the first example. The jackpot pool may have a starting value that is the same as the minimum jackpot level, in this example $20. The amount by which the jackpot pool is incremented may be, for example, the product of the total amount wagered for that particular non-winning game and the allocated weight.

If the pool value equals or exceeds the trigger number in response to incrementing the pool value, then the trigger condition is determined and a prize is allocated in response to the wager that caused the pool value to equal or exceed the trigger value. The allocated prize may be the same as the trigger number. In the above example, the allocated prize may therefore be $30.

A gaming system that utilises the general concept of facilitating selection of one or more win lines by a player, allocates a weight that is dependent on the number of win lines selected and allocates a prize in response to determining a trigger condition that is dependent on the allocated weight will now be described in more detail.

The description that follows generally describes a gaming system that is arranged to display virtual reels, however it will be appreciated that a similar idea may be applied to a gaming system that employs mechanical reels.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. The system is of the type including multiple game modes such as being operable in normal game mode wherein a base game is implemented and special game mode wherein a feature game is implemented.

With some such probabilistic games, the set of symbols used during normal game mode include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display along a win line, or are displayed according to defined outcome patterns such as scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

Referring to FIG. 1, a schematic diagram of components of a gaming system 10 in accordance with the present embodiment is shown. The components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game play instructions.

Figure 3:
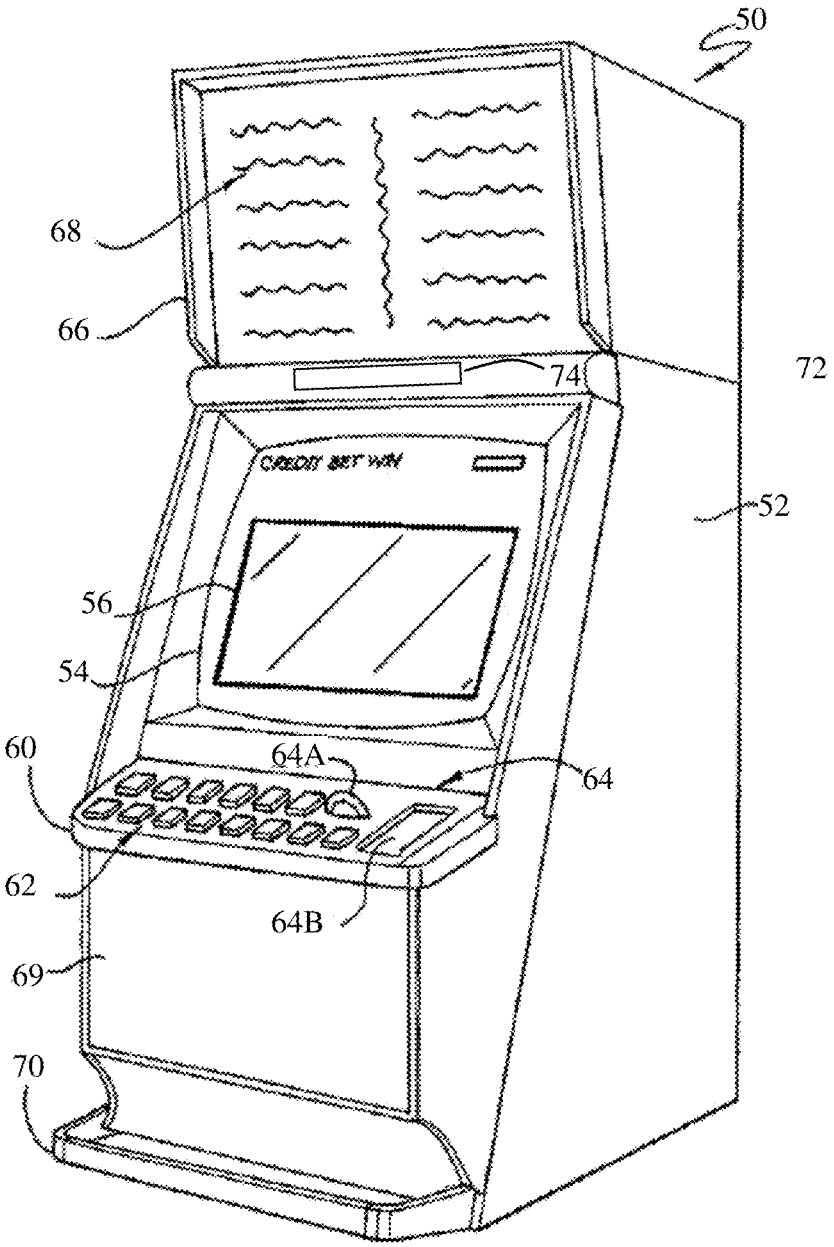
FIG. 3 is a diagrammatic representation of a gaming system in accordance with an embodiment of the present invention with the gaming system implemented in the form of a stand-alone gaming machine.

The player instructions may be input by pressing appropriate buttons such as buttons 62 shown in FIG. 3, or by interacting with a display 54 that comprises a touch screen usable by the player to interact with the gaming system 10.

In this example, the game play mechanism 38 is arranged to allow a player to select a number of win lines, and to instruct the gaming system 10 to initiate a game.

The game controller 32 is in data communication with the player interface 30 and typically includes a processor 40 arranged to process game play instructions and output game play outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
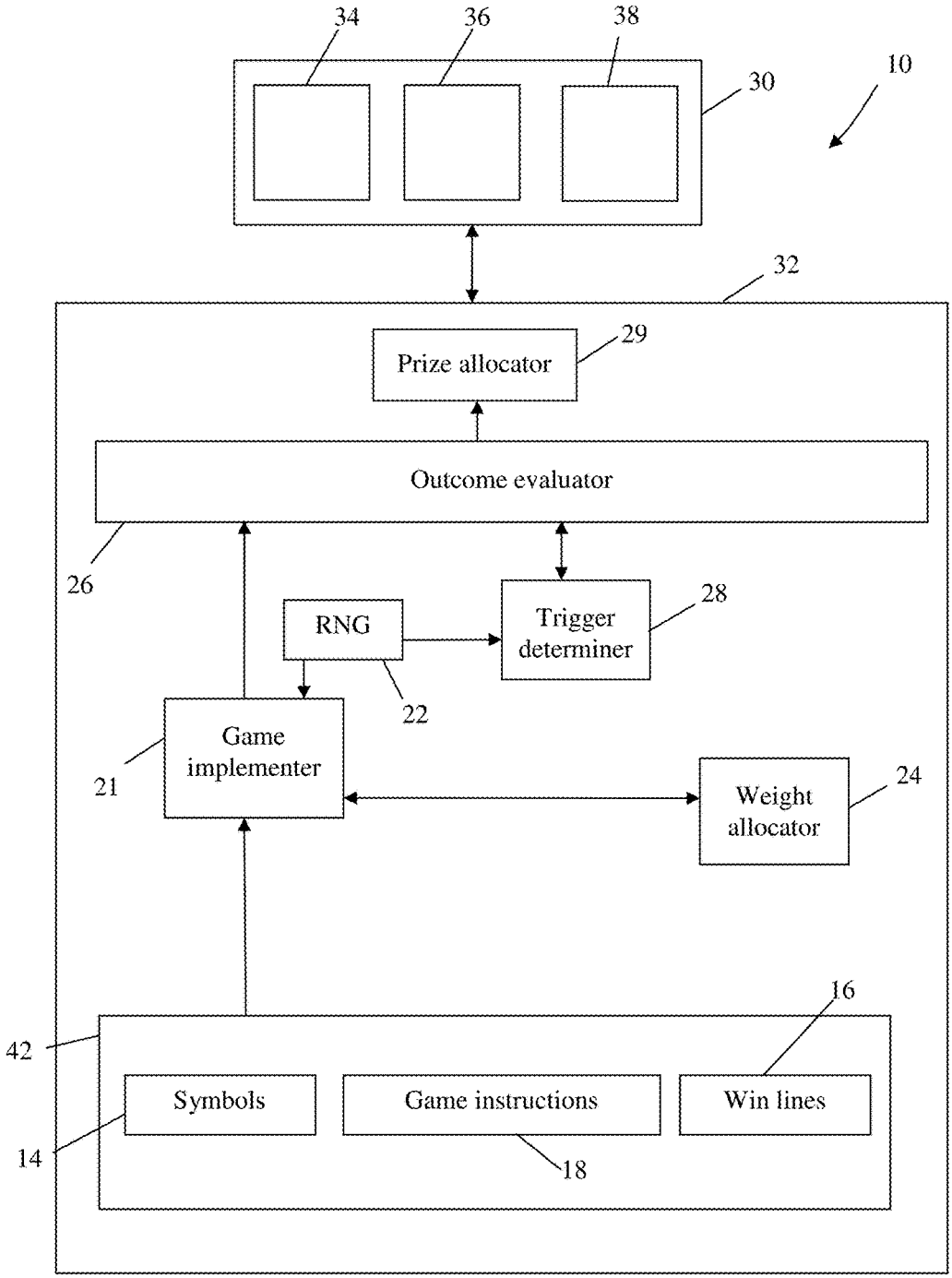
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols, in the present example associated with a plurality of reels, win lines data 16 indicative of available win lines, and game instruction data 18 indicative of game instructions usable by the gaming machine 10 to control operation of the game.

The game controller 32 comprises a game implementer 21 which is arranged to select several symbols from the available symbols 14 for display to a player in a plurality of display positions of the reels. In this example, the selection carried out by the game implementer 21 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

The game controller 32 further includes a weight allocator 24 that is arranged to allocate a weight to a particular wager based on the number of win lines selected by the player. In one example, the weight allocator 24 allocates a weight to a wager based on the weight allocation table shown in Table 1. In this example, the weight allocation table is stored by the weight allocator 24, although it will be appreciated that the weight allocation table may be stored in the memory 42.

The game controller 32 also comprises an outcome evaluator 26 which, in accordance with game instructions 18 determines game outcomes based on the symbols selected by the game implementer 21.

The game controller also comprises a trigger determiner 28. If the outcome evaluator 26 determines that a particular game is a non-winning game, the trigger determiner 28 is arranged to determine if a trigger condition exists. The trigger determiner can be arranged to determine if a trigger condition exists in accordance with various methods, as described in more detail later with reference to FIGS. 7 to 9.

The game controller 32 also comprises a prize allocator 29 arranged to allocate a prize to a player when a winning outcome exists, or to allocate a prize to a player if the trigger determiner 28 determines that a trigger condition exists in response to a non-winning game.

In the embodiment described below, the game implementer 21, the random number generator 22, the weight allocator 24, the outcome evaluator 26, the trigger determiner 28, and the prize allocator 29 are at least partly implemented using the processor 40 and associated software although it will be understood that other implementations are envisaged.

The gaming system 10 can take a number of different forms.

In a first form, a player operable gaming device in the form of a stand alone gaming machine is provided wherein all or most components required for implementing the game are present in the gaming machine.

In a second form, a distributed architecture is provided wherein some of the components required for implementing the game are present in a player operable gaming device and some of the components required for implementing the game are located remotely relative to the gaming device. For example, a "thick client" architecture may be used wherein part of the game is executed on a player operable gaming terminal and part of the game is executed remotely, such as by a gaming server; or a "thin client" architecture may be used wherein most of the game is executed remotely such as by a gaming server and a player operable gaming terminal is used only to display audible and/or visible gaming information to the player and receive gaming inputs from the player.

However, it will be understood that other arrangements are envisaged. For example, an architecture may be provided wherein a gaming device is networked to a device server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

A gaming system in the form of a stand alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 62 for enabling a player to interact with the gaming machine, in particular during gameplay. The mid-trim 60 also houses a credit input mechanism 64 which in this example includes a coin input chute 64A and a bill collector 64B. Other credit input mechanisms may also be employed, for example, a card reader for reading a smart card, debit card or credit card.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 69 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type. The display 54 may comprise a touch screen usable by a player to interact with the gaming machine, in particular during game play.

The display 54 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols.

A player marketing module (PMM) 72 having a display 74 is connected to the gaming machine 50. The main purpose of the PMM 72 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 62 is a Sentinel III device produced by Aristocrat Technologies Pty Ltd.

Figure 4:
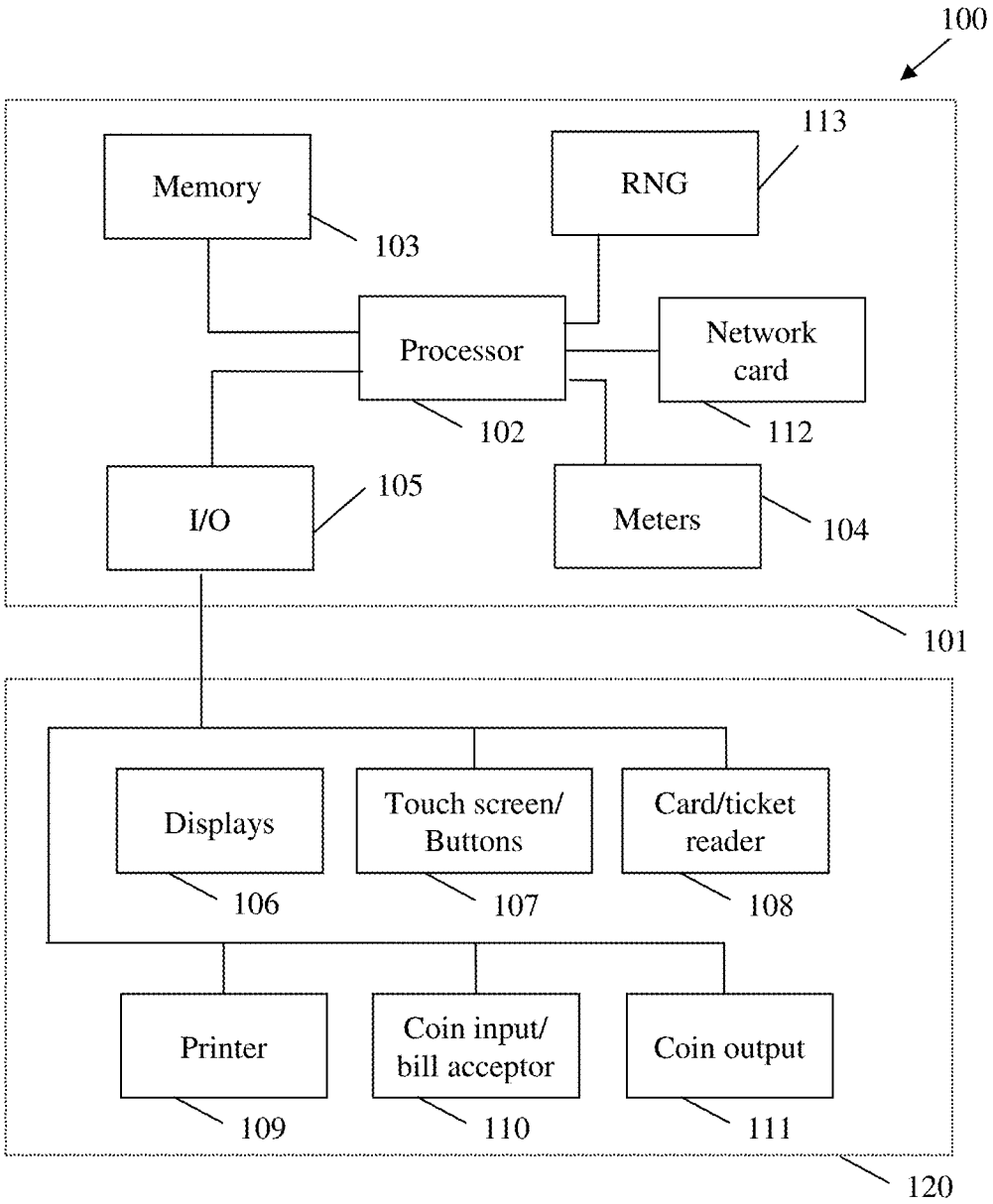
FIG. 4 is a schematic block diagram of operative components of the gaming machine shown in FIG. 3.

FIG. 4 shows a block diagram of operative components of a gaming device 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
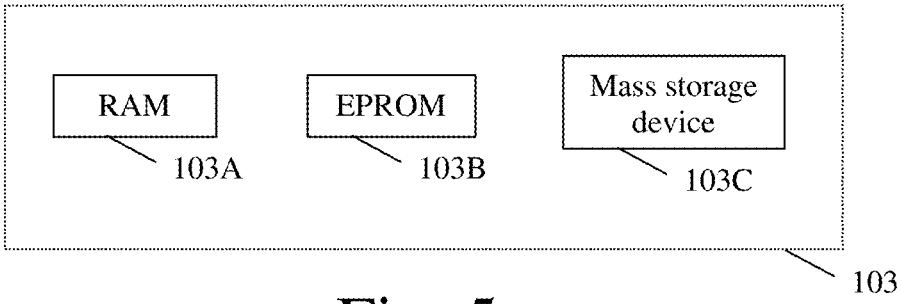
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 6:
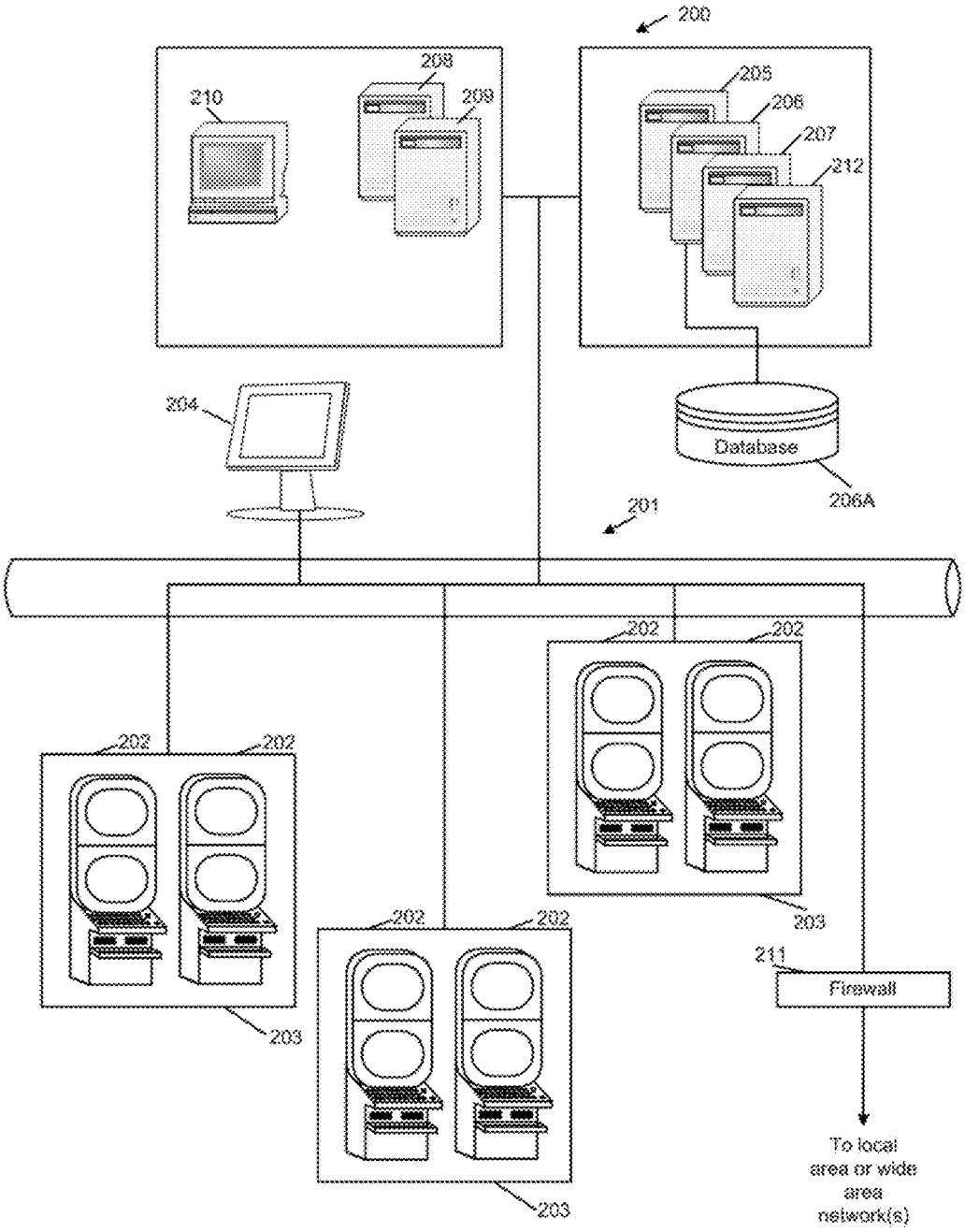
FIG. 6 is a schematic diagram of a gaming system in accordance with an alternative embodiment of the present invention wherein the gaming system is implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40, 100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

Examples of specific implementations of the gaming system will now be described in relation to a stand alone gaming machine 50 although it will be understood that implementation may also be carried out using other gaming system architectures such as a network architecture of the type shown in FIG. 6.

In this example, the gaming system comprises five reels, each reel corresponding to a display position group, each of which has an associated set of display positions for displaying symbols.

The reels are arranged to display standard symbols and one or more function symbols and win outcomes are determined on the basis of the symbols visible at the display positions when the reels stop rotating.

Typically, a player will purchase or otherwise obtain win entitlements such as several win lines which are used in the game to determine win outcomes. If the displayed symbols on the reels have symbols associated with a winning combination such as a winning combination disposed on a win line, the player wins a prize.

The gaming system is operable in normal game mode and special game mode and may be arranged to commence special game mode when a predetermined game outcome occurs. Special game mode may comprise one or more free games. Special game mode may commence automatically on the basis of a game event occurring during a game such as display of a particular symbol, based on game outcomes determined by the gaming system, or may be prompted by a player pressing a button on the gaming system 10 after the player has identified that a game outcome corresponding to special game mode requirements has occurred.

The gaming system 10 may also be arranged so as to determine eligibility for special game mode, for example based on the amount or type of bet placed, based on certain time periods and so on.

Special game mode may also be arranged to commence when a special game is purchased by a player.

Figure 7:
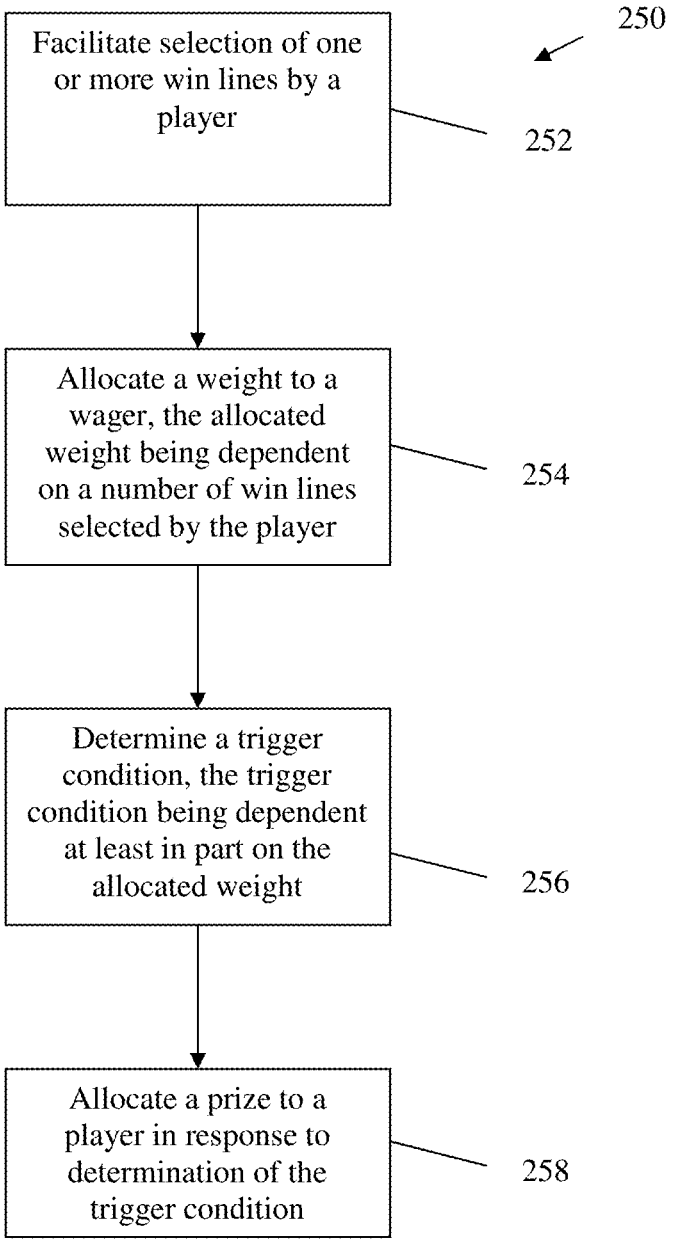
FIG. 7 is a flow diagram illustrating a method of gaming in accordance with an embodiment of the present invention.

As discussed earlier, for non-winning games, the gaming system is arranged to determine whether a trigger condition exists and to allocate a prize to a player in response to determination of a trigger condition. This process is described in more detail with reference to flow diagram 250 as shown in FIG. 7. Two different examples of how a gaming system may be arranged to determine a trigger condition will then be described with reference to FIGS. 8 and 9.

Referring now to FIG. 7, in a first step 252 the gaming system facilitates selection of one or more win lines by a player. In a second step 254, the gaming system is arranged to allocate a weight to a wager. The allocated weight is dependent on the number of win lines that have been selected by the player in the first step 252.

In this example, the weight that is allocated to the wager in step 254 is determined based on the weight allocation table shown in Table 1 and is implemented by the weight allocator 24. It will be appreciated that the weight allocation table of Table 1 is but one example of a possible weight allocation table, although generally weight allocation tables to be used will be arranged such that the weighting increases for an increase in the number of selected win lines. Weights to be allocated in respect of a wager are intended to offset the probability of a win as the trigger condition is only determined for non-winning games. The allocated weights can be equated to hit rates of non-winning games, and can be calculated for particular reel and win line configurations based on mathematical simulation.

In a third step 256, a trigger condition is determined. The trigger condition is dependent at least in part on the allocated weight, generally such that there is a probability that a trigger condition is proportional to the number of win lines selected by the player for that particular non-winning game. In this example, the trigger condition is determined 256 by the trigger determiner 28.

If a trigger condition is determined, then in a third step 258 a prize is allocated.

Figure 8:
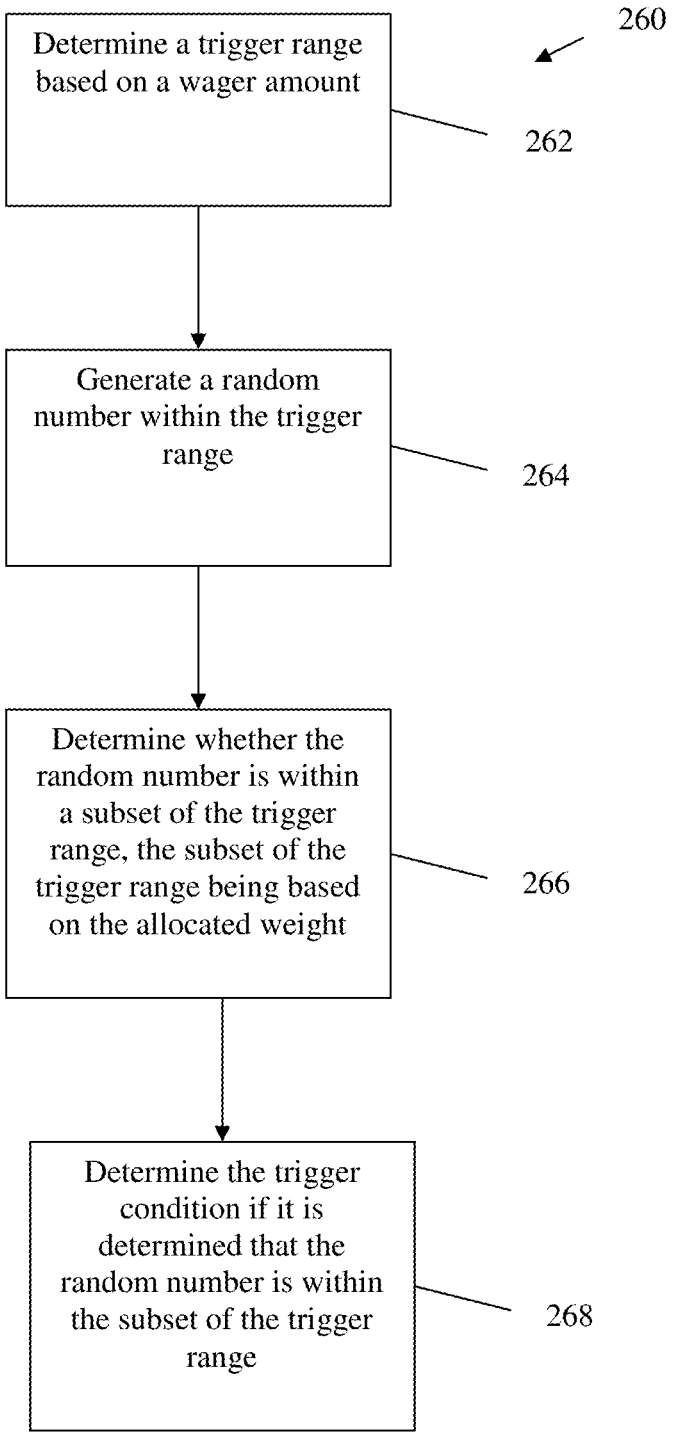
FIG. 8 is a flow diagram illustrating a step of determining a trigger in accordance with the method of FIG. 7.
Figure 9:
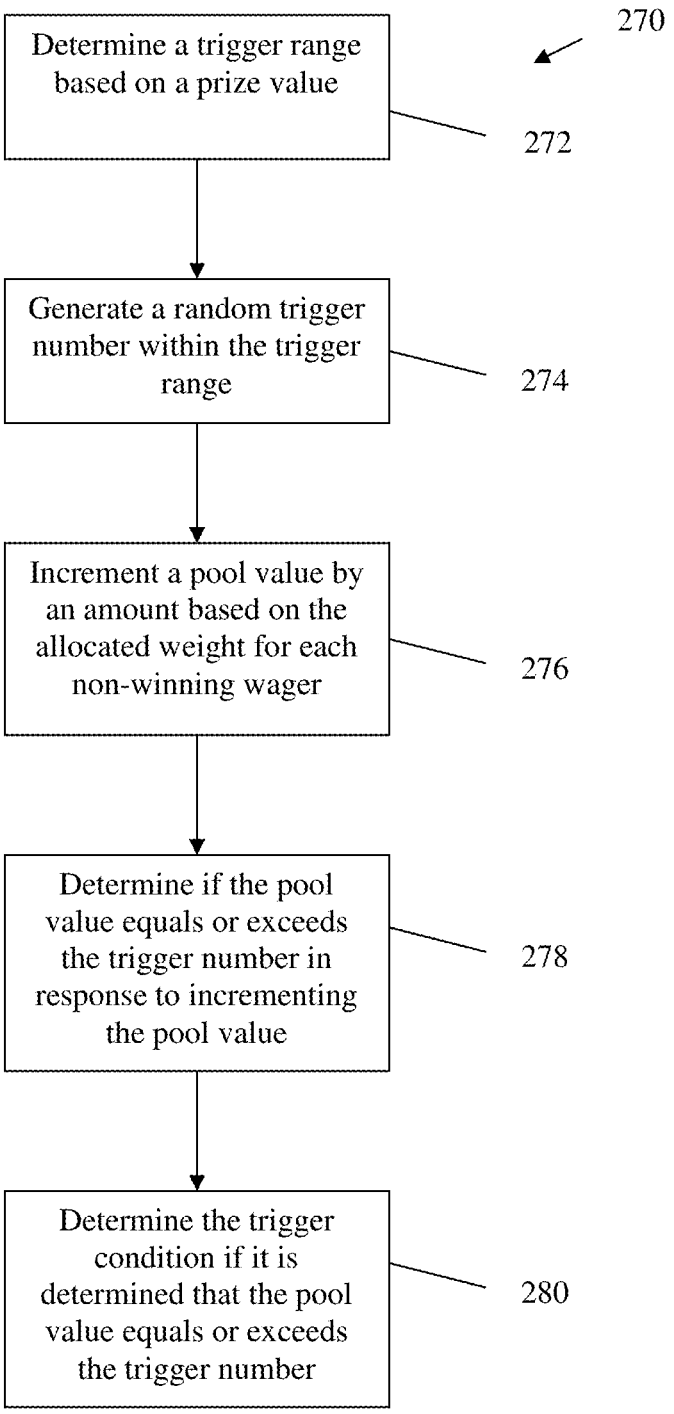
FIG. 9 is a flow diagram illustrating a method of gaming in accordance with an embodiment of the present invention

FIGS. 8 and 9 illustrate two different ways in which the trigger condition can be determined 256.

FIG. 8 shows a flow diagram 260 that illustrates a first example of a method of determining the trigger condition 256. The flow diagram 260 is based on a modified version of the so-called 'hyperlink trigger'.

In a first step 262, the gaming system is arranged to determine a trigger range based on a wager amount. As discussed earlier, the trigger range is proportionally narrower for higher wager amounts such that the chance that a trigger condition is determined is proportional to the wager amount.

In this example, the trigger range ranges from 1 to a maximum trigger range number. The maximum trigger range number is determined by first determining an average value of turnover of the gaming system between successive jackpot prizes being allocated. The average value of turnover is then divided by the cost of the wager on the gaming system. For example, if the average turnover value of the gaming system between jackpots is $1,000, the maximum trigger range number will be 20,000 for a wager of 5c (i.e., $1,000/$0.05=20,000), and the maximum trigger range number for a wager of 10c will be 10,000 (i.e., $1,000/$0.10=10,000).

In a second step 264, a random number is generated within the trigger range. The random number can be generated using the random number generator 22, which is in communication with the trigger determiner 28.

In a third step 266, the gaming system determines whether the random number generated in the second step 264 falls within a subset of the trigger range. The subset of the trigger range is proportional to the weight that has been allocated to the wager. Therefore, the probability that the random number falls within the subset of the trigger range increases in proportion to the number of win lines selected by the player. For example, there will be a higher chance that the random number falls within the subset of the trigger range if the player has selected 20 win lines, with a corresponding weight of 1.454, compared to if the player has only selected 1 win line, with a corresponding weight of 1.123 (see Table 1).

In this example, the subset of the trigger range ranges from 1 to a product of a total amount wagered for that particular game and the allocated weight. For example, if the player selects 20 lines for a total cost of 20c, the subset of the trigger range will range from 1 to 29.08 (i.e., (20)*(1.454)=29.08).

If it is determined that the random number falls within the subset of the trigger range, then in a fourth step 268 the gaming system is arranged to determine the trigger condition. A prize is then allocated as per the fourth step 258 of the flow diagram 250.

In this example, the allocated prize is a jackpot prize, and is particularly either a major or a minor jackpot prize. In this example, the jackpot prize information is stored in the jackpot server 207.

If a prize is to be allocated as a result of determination of the trigger condition 268, the gaming system then makes a determination as to whether the major or the minor jackpot prize is allocated, for example by using the jackpot weighting table of Table 2. The jackpot weighting table is, in this example, stored by the jackpot server 207.

Using the jackpot weighting table of Table 2, the gaming system generates a random number between 1 and 100,000, for example by using the random number generator 22. If the random number is equal to 1, then the major jackpot prize is awarded. If the random number falls within the range of 2 to 100,000, then the minor jackpot prize is awarded.

As discussed earlier, the major jackpot prize is set to a maximum allowed amount, such as $500, and the minor jackpot prize is a progressive jackpot that starts at a minimum value, such as $20, and increments based on wagers that have been input to the gaming system until a maximum amount. In this particular example, the progressive jackpot is incremented by 2% of all wagers, that is, both winning and non-winning wagers. In this example, the progressive jackpot is a standalone progressive jackpot, although it will be appreciated that a linked progressive jackpot system may be implemented.

Although only one progressive jackpot has been described, it will be appreciated that more than one progressive jackpot may be implemented wherein each progressive jackpot has its own rate of incrementing based on wagers that have been input to the gaming system.

It will also be appreciated that the progressive jackpot may be implemented as a standalone progressive jackpot or as a linked progressive jackpot.

In the above example, the trigger range and the allocated weight are multiplied by a factor of 1000. Multiplying the trigger range and the allocated weight by a factor of 1000 improves a level of accuracy of the determination of the trigger condition such that a return to player percentage and a probability of being awarded a prize are substantially proportional across different wager amounts. The factor by which the trigger range and the allocated weight are multiplied may be stored by the trigger determiner 28, or in the memory 42.

A numerical example will now be used to illustrate the flowchart 250 of FIG. 7, wherein the step of determining the trigger condition 256 is based on the flowchart 260 of FIG. 8.

In this example, a player plays a 5c game on a gaming machine having an average turnover value of $1,000. The player selects 20 lines for a cost of 20c and a non-winning game occurs.

The trigger range is determined 262 to be from 1 to 20,000, and this amount is multiplied by 1,000 to give a multiplied trigger range of 1,000 to 20,000,000, and a random number is generated 264 between the multiplied trigger range.

If the random number is determined 266 to fall within a subset of the multiplied trigger range, that is, between 1,000 and the product of the total amount wagered for this particular game and the allocated weight, and further multiplied by the factor of 1,000 (i.e., 20*1.454*1,000=29,080), then the trigger condition is determined 268. That is, if the random number falls between 1,000 and 29,080, then a trigger condition is determined 268,256 and a prize is allocated. The prize amount allocated is determined based on the jackpot weighting table (see Table 2) and the major and minor jackpot amounts.

FIG. 9 shows a flow diagram 270 that illustrates a second example of a method of determining the trigger condition 256. The flow diagram 270 is based on a modified version of the so-called 'mystery trigger'.

In a first step 272, the gaming system is arranged to determine a trigger range based on a prize value. As discussed earlier, the trigger range may range from a minimum jackpot prize level, such as $20, to a maximum jackpot level, such as $40.

In a second step 274, a random trigger number is generated within the trigger range. The random trigger number is generated, in this example, by the random number generator 22. As an example, the trigger number is randomly generated to have a value of $30. The minimum and maximum jackpot values, and the generated trigger number, are stored by the jackpot server 207.

A jackpot pool having a starting value that is the same as the minimum jackpot level (i.e., $20) is also stored by the jackpot server 207 and is incremented by an amount based on the allocated weight for each non-winning wager, the allocated weight being based on Table 1.

In this example, the amount by which the jackpot pool is incremented is equal to the product of the total amount wagered for that particular non-winning game and the allocated weight. For example, if the player wagers a total of 20c and selects 20 lines, the jackpot pool will be incremented by an amount of 29.08c (i.e., 20c*1.454=29.08c).

If the pool value equals or exceeds the trigger number in response to incrementing the pool value, then the trigger condition is determined and a prize is allocated in response to the wager that caused the pool value to equal or exceed the trigger value. In this example, the allocated prize is the same as the trigger number, that is, the allocated prize is $30.

In this particular example, the jackpot pool is incremented in response to non-winning wagers that are made on a particular gaming machine. That is, the jackpot pool is akin to a standalone progressive jackpot. It will be appreciated, however, that the jackpot pool may be shared between linked machines, such that the jackpot pool is akin to a linked progressive jackpot and wherein the prize is allocated in response to a non-winning wager made on a particular linked gaming machine that causes the jackpot pool to equal or exceed the trigger value.

Modifications and variations as would be apparent to a skilled addressee are determined to be within the scope of the present invention.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A gaming machine comprising:

a player interface comprising:

a credit input mechanism configured to accept a physical item associated with a monetary value for establishing a credit balance, the credit balance being increasable and decreasable based at least on wagering activity, a hardware meter configured to monitor the credit balance having been established via the credit input mechanism, and a game play device configured to:

receive an input by a player corresponding with wagers in accord with having established the credit balance at the gaming machine, the received wagers on one or more games playable at the gaming machine, the received wagers deducted from the credit balance, and receive a selection of one or more win lines by the player;

a game controller comprising:

a weight allocator for allocating a weight to a wager, the allocated weight being dependent on a number of win lines selected by the player;

a prize allocator; and a trigger determiner configured to determine a trigger condition, the trigger condition being dependent at least in part on the allocated weight;

wherein the game controller is configured to allocate a prize to the player in response to determination of the trigger condition;

wherein the game controller is configured to determine the trigger condition and/or allocate the prize only in response to a non-winning game; and a payout mechanism configured to provide at least a portion of the prize to the player.

2. The gaming machine of claim 1, wherein the game controller is configured to:

determine a trigger range based on a wager amount, the trigger range comprising at least one winning subset and at least one losing subset;

generate a random number within the trigger range;

determine whether the random number is within the winning subset of the trigger range, the winning subset of the trigger range being based on the wager amount and the allocated weight corresponding with the number of win lines selected by the player; and determine the trigger condition if it is determined that the random number is within the winning subset of the trigger range.

3. The gaming machine of claim 2, wherein the trigger range is a range from a minimum trigger range number to a maximum trigger range number, the maximum trigger range number being based on the wager amount, and wherein the minimum and maximum trigger range numbers and the allocated weight are multiplied by a predetermined factor.

4. The gaming machine of claim 2, wherein the trigger range is a range from a minimum trigger range number to a maximum trigger range number, the maximum trigger range number being based on the wager amount.

5. The gaming machine of claim 2, wherein the winning subset of the trigger range is a range from a minimum subset range number to a maximum subset range number, the maximum subset range number being based on the wager amount multiplied by the allocated weight corresponding with the number of win lines selected by the player.

6. The gaming machine of claim 3, comprising a jackpot determiner configured to:

store information that is indicative of at least one jackpot value, and allocate the at least one jackpot value as a prize to a player in response to determination of the trigger condition.

7. The gaming machine of claim 6, wherein the jackpot determiner is configured to:

store information that is indicative of a major jackpot prize and a minor jackpot prize, and make a determination as to whether the major or the minor jackpot prize is allocated.

8. The gaming machine of claim 7, wherein the jackpot determiner determines which jackpot prize to allocate based on a jackpot weighting table.

9. The gaming machine of claim 7, wherein if a location of the gaming machine is in a jurisdiction having a maximum value of the prize that is allowed by gambling laws, the major jackpot prize is the maximum value that is allowed by the gambling laws of the jurisdiction corresponding with the location of the gaming machine.

10. The gaming machine of claim 7, wherein the minor jackpot prize is a progressive jackpot prize that has a starting minimum value and that increases by increments based on wagers that have been input to the gaming machine until a maximum amount.

11. The gaming machine of claim 10, wherein the minor jackpot prize has an associated incrementing rate.

12. The gaming machine of claim 10, wherein the minor jackpot prize is reset to the starting minimum value in response to the minor jackpot prize being allocated.

13. The gaming machine of claim 10, wherein the minor jackpot prize is one of a plurality of progressive jackpot prizes.

14. The gaming machine of claim 13, wherein each minor jackpot prize has a respective incrementing rate.

15. The gaming machine of claim 1, wherein the game controller is configured to:

determine a trigger range based on a prize value;

generate a random trigger number within the trigger range;

increment a pool value by an amount based on the allocated weight for each non-winning wager;

determine if the pool value equals or exceeds the trigger number in response to incrementing the pool value; and determine the trigger condition if it is determined that the pool value equals or exceeds the trigger number.

16. The gaming machine of claim 15, wherein the trigger range is a range from a minimum trigger range number to a maximum trigger range number, the maximum trigger range number being based on the prize value.

17. The gaming machine of claim 16, wherein the maximum trigger range number is the same as a maximum prize value.

18. The gaming machine of claim 16, wherein the minimum trigger range number is based on a further prize value.

19. The gaming machine of claim 15, wherein the pool value starts at a defined minimum pool value.

20. The gaming machine of claim 19, wherein the minimum trigger range number is based on a further prize value, and wherein the minimum pool value is the same as the further prize value.

21. The gaming machine of claim 15, wherein the allocated prize is based on the random trigger number.

22. The gaming machine of claim 1, wherein the game controller executes a computer program stored on a non-transitory computer readable medium.

23. The gaming machine of claim 1, comprising a non-transitory computer readable medium having a computer readable program code executable by the game controller.

24. A method of gaming at a gaming machine comprising a player interface, a game controller, and a payout mechanism, the player interface having a credit input mechanism, a hardware meter, and a game play device, the credit input mechanism configured to accept a physical item associated with a monetary value for establishing a credit balance, the credit balance being increasable and decreasable based at least on wagering activity, the hardware meter configured to monitor the credit balance having been established via the credit input mechanism, the game play device configured to receive an input by a player corresponding with wagers in accord with having established the credit balance at the gaming machine, the received wagers on one or more games playable at the gaming machine, the received wagers deducted from the credit balance, the game play device configured to receive a selection of one or more win lines by the player, the method comprising the steps of:

facilitating selection of the one or more win lines by the player at the game play device;

allocating, via the game controller, a weight to a wager, the allocated weight being dependent on a number of win lines selected by the player;

determining, via the game controller, a trigger condition, the trigger condition being dependent at least in part on the allocated weight;

allocating, via the game controller, a prize to the player in response to determination of the trigger condition; and providing, via the payout mechanism, at least a portion of the prize to the player, wherein the step of determining the trigger condition and/or allocating the prize is performed only in response to a non-winning game.

25. The method of claim 24, comprising the steps of:

determining, via the game controller, a trigger range based on a wager amount, the trigger range comprising at least one winning subset and at least one losing subset;

generating, via the game controller, a random number within the trigger range;

determining, via the game controller, whether the random number is within the winning subset of the trigger range, the winning subset of the trigger range being based on the wager amount and the allocated weight corresponding with the number of win lines selected by the player; and determining, via the game controller, the trigger condition if it is determined that the random number is within the winning subset of the trigger range.

26. The method of claim 25, wherein the trigger range is a range from a minimum trigger range number to a maximum trigger range number, the maximum trigger range number being based on the wager amount, and wherein the minimum and maximum trigger range numbers and the allocated weight are multiplied by a predetermined factor.

27. The method of claim 25, wherein the trigger range is a range from a minimum trigger range number to a maximum trigger range number, the maximum trigger range number being based on the wager amount.

28. The method of claim 25, wherein the winning subset of the trigger range is a range from a minimum subset range number to a maximum subset range number, the maximum subset range number being based on the wager amount multiplied by the allocated weight corresponding with the number of win lines selected by the player.

29. The method of claim 25, comprising the steps of:

storing information that is indicative of at least one jackpot value; and allocating the at least one jackpot value as a prize to a player in response to determining of the trigger condition.

30. The method of claim 29, comprising the steps of:

storing information that is indicative of a major jackpot prize and a minor jackpot prize; and determining whether to allocate the major or the minor jackpot prize.

31. The method of claim 30, wherein the step of determining which jackpot prize to allocate is based on a jackpot weighting table.

32. The method of claim 30, wherein if a location of the gaming machine is in a jurisdiction having a maximum value of the prize that is allowed by gambling laws, the major jackpot prize is the maximum value that is allowed by the gambling laws of the jurisdiction corresponding with the location of the gaming machine.

33. The method of claim 30, wherein the minor jackpot prize is a progressive jackpot prize that has a starting minimum value and that increases by increments based on input wagers until a maximum amount.

34. The method of claim 33, wherein the minor jackpot prize has an associated incrementing rate.

35. The method of claim 33, comprising the step of resetting the minor jackpot prize to the starting minimum value in response to the minor jackpot prize being allocated.

36. The method of claim 33, wherein the minor jackpot prize is one of a plurality of progressive jackpot prizes.

37. The method of claim 36, wherein each minor jackpot prize has a respective incrementing rate.

38. The method of claim 24, comprising the steps of:

determining, via the game controller, a trigger range based on a prize value;

generating, via the game controller, a random trigger number within the trigger range;

incrementing, via the game controller, a pool value by an amount based on the allocated weight for each non-winning wager;

determining, via the game controller, if the pool value equals or exceeds the trigger number in response to incrementing the pool value; and determining, via the game controller, the trigger condition if it is determined that the pool value equals or exceeds the trigger number.

39. The method of claim 38, wherein the trigger range is a range from a minimum trigger range number to a maximum trigger range number, the maximum trigger range number being based on the prize value.

40. The method of claim 39, wherein the maximum trigger range number is the same as a maximum prize value.

41. The method of claim 39, wherein the minimum trigger range number is based on a further prize value.

42. The method of claim 38, wherein the pool value starts at a defined minimum pool value.

43. The method of claim 42, wherein the minimum trigger range number is based on a further prize value, and wherein the minimum pool value is the same as the further prize value.

44. A gaming machine comprising:

a player interface comprising:

a credit input mechanism configured to accept a physical item associated with a monetary value for establishing a credit balance, the credit balance being increasable and decreasable based at least on wagering activity, a hardware meter configured to monitor the credit balance having been established via the credit input mechanism, and a game play device configured to:

receive an input by a player corresponding with wagers in accord with having established the credit balance at the gaming machine, the received wagers on one or more games playable at the gaming machine, the received wagers deducted from the credit balance, and receive a selection of one or more win lines by the player;

a game controller comprising:

a weight allocator for allocating a weight to a wager, the allocated weight being dependent on a number of win lines selected by the player;

a prize allocator; and a trigger determiner configured to determine a trigger condition, the trigger condition being dependent at least in part on the allocated weight;

wherein the game controller is configured to:

determine a trigger range based on a wager amount, the trigger range comprising at least one winning subset and at least one losing subset;

generate a random number within the trigger range;

determine whether the random number is within the winning subset of the trigger range, the winning subset of the trigger range being based on the wager amount and the allocated weight corresponding with the number of win lines selected by the player, wherein the winning subset of the trigger range is a range from a minimum subset range number to a maximum subset range number, the maximum subset range number being based on the wager amount multiplied by the allocated weight corresponding with the number of win lines selected by the player; and determine the trigger condition if it is determined that the random number is within the winning subset of the trigger range;

wherein the game controller is configured to allocate a prize to the player in response to determination of the trigger condition; and a payout mechanism configured to provide at least a portion of the prize to the player.

45. The gaming machine of claim 44, wherein the game controller executes a computer program stored on a non-transitory computer readable medium.

46. The gaming machine of claim 44, comprising a non-transitory computer readable medium having a computer readable program code executable by the game controller.

47. The gaming machine of claim 44, wherein the trigger range is a range from a minimum trigger range number to a maximum trigger range number, the maximum trigger range number being based on the wager amount.

48. The gaming machine of claim 44, comprising a jackpot determiner configured to:

store information that is indicative of at least one jackpot value, and allocate the at least one jackpot value as a prize to a player in response to determination of the trigger condition.

49. The gaming machine of claim 48, wherein the jackpot determiner is configured to:

store information that is indicative of a major jackpot prize and a minor jackpot prize, and make a determination as to whether the major or the minor jackpot prize is allocated.

50. The gaming machine of claim 49, wherein the jackpot determiner determines which jackpot prize to allocate based on a jackpot weighting table.

51. The gaming machine of claim 49, wherein if a location of the gaming machine is in a jurisdiction having a maximum value of the prize that is allowed by gambling laws, the major jackpot prize is the maximum value that is allowed by the gambling laws of the jurisdiction corresponding with the location of the gaming machine.

52. The gaming machine of claim 49, wherein the minor jackpot prize is a progressive jackpot prize that has a starting minimum value and that increases by increments based on wagers that have been input to the gaming machine until a maximum amount.

53. The gaming machine of claim 52, wherein the minor jackpot prize has an associated incrementing rate.

54. The gaming machine of claim 52, wherein the minor jackpot prize is reset to the starting minimum value in response to the minor jackpot prize being allocated.

55. The gaming machine of claim 52, wherein the minor jackpot prize is one of a plurality of progressive jackpot prizes.

56. The gaming machine of claim 55, wherein each minor jackpot prize has a respective incrementing rate.

57. The gaming machine of claim 44, wherein the trigger range is a range from a minimum trigger range number to a maximum trigger range number, the maximum trigger range number being based on the wager amount, and wherein the minimum and maximum trigger range numbers and the allocated weight are multiplied by a predetermined factor.

58. A method of gaming at a gaming machine comprising a player interface, a game controller, and a payout mechanism, the player interface having a credit input mechanism, a hardware meter, and a game play device, the credit input mechanism configured to accept a physical item associated with a monetary value for establishing a credit balance, the credit balance being increasable and decreasable based at least on wagering activity, the hardware meter configured to monitor the credit balance having been established via the credit input mechanism, the game play device configured to receive an input by a player corresponding with wagers in accord with having established the credit balance at the gaming machine, the received wagers on one or more games playable at the gaming machine, the received wagers deducted from the credit balance, the game play device configured to receive a selection of one or more win lines by the player, the method comprising the steps of:

facilitating selection of the one or more win lines by the player at the game play device;

allocating, via the game controller, a weight to a wager, the allocated weight being dependent on a number of win lines selected by the player;

determining, via the game controller, a trigger condition, the trigger condition being dependent at least in part on the allocated weight;

determining, via the game controller, a trigger range based on a wager amount, the trigger range comprising at least one winning subset and at least one losing subset;

generating, via the game controller, a random number within the trigger range;

determining, via the game controller, whether the random number is within the winning subset of the trigger range, the winning subset of the trigger range being based on the wager amount and the allocated weight corresponding with the number of win lines selected by the player, wherein the winning subset of the trigger range is a range from a minimum subset range number to a maximum subset range number, the maximum subset range number being based on the wager amount multiplied by the allocated weight corresponding with the number of win lines selected by the player;

determining, via the game controller, the trigger condition if it is determined that the random number is within the winning subset of the trigger range;

allocating, via the game controller, a prize to the player in response to determination of the trigger condition; and providing, via the payout mechanism, at least a portion of the prize to the player.

59. The method of claim 58, wherein the trigger range is a range from a minimum trigger range number to a maximum trigger range number, the maximum trigger range number being based on the wager amount.

60. The method of claim 58, comprising the steps of:

storing information that is indicative of at least one jackpot value; and allocating the at least one jackpot value as a prize to a player in response to determining of the trigger condition.

61. The method of claim 60, comprising the steps of:

storing information that is indicative of a major jackpot prize and a minor jackpot prize; and determining whether to allocate the major or the minor jackpot prize.

62. The method of claim 61, wherein the step of determining which jackpot prize to allocate is based on a jackpot weighting table.

63. The method of claim 61, wherein if a location of the gaming machine is in a jurisdiction having a maximum value of the prize that is allowed by gambling laws, the major jackpot prize is the maximum value that is allowed by the gambling laws of the jurisdiction corresponding with the location of the gaming machine.

64. The method of claim 61, wherein the minor jackpot prize is a progressive jackpot prize that has a starting minimum value and that increases by increments based on input wagers until a maximum amount.

65. The method of claim 64, wherein the minor jackpot prize has an associated incrementing rate.

66. The method of claim 64, comprising the step of resetting the minor jackpot prize to the starting minimum value in response to the minor jackpot prize being allocated.

67. The method of claim 64, wherein the minor jackpot prize is one of a plurality of progressive jackpot prizes.

68. The method of claim 67, wherein each minor jackpot prize has a respective incrementing rate.

69. The method of claim 58, wherein the trigger range is a range from a minimum trigger range number to a maximum trigger range number, the maximum trigger range number being based on the wager amount, and wherein the minimum and maximum trigger range numbers and the allocated weight are multiplied by a predetermined factor.

* * * * *